US008770173B2

(12) United States Patent
Han et al.

(10) Patent No.: US 8,770,173 B2
(45) Date of Patent: Jul. 8, 2014

(54) MULTI-PHASE ENGINE STOP POSITION CONTROL

(75) Inventors: Jun Han, Ann Arbor, MI (US); Lan Wang, Troy, MI (US); Goro Tamai, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1120 days.

(21) Appl. No.: 12/759,898

(22) Filed: Apr. 14, 2010

(65) Prior Publication Data

US 2011/0253099 A1 Oct. 20, 2011

(51) Int. Cl.

| | |
|---|---|
| ***F02D 41/00*** | (2006.01) |
| *F02N 11/08* | (2006.01) |
| *F02N 19/00* | (2010.01) |
| *F02D 41/04* | (2006.01) |

(52) U.S. Cl.

CPC ..... *F02N 11/0818* (2013.01); *F02N 19/005* (2013.01); *F02D 41/042* (2013.01); *F02N 2019/008* (2013.01)

USPC ..... 123/350; 123/179.4

(58) Field of Classification Search

CPC ..... F02D 2041/0092; F02D 41/042; F02N 11/0818; F02N 19/005; F02N 19/008

USPC ..... 123/350, 179.3, 179.4; 903/905, 906; 701/112

See application file for complete search history.

(56) References Cited

U.S. PATENT DOCUMENTS

| | | | | |
|---|---|---|---|---|
| 6,192,847 | B1 * | 2/2001 | Davis | 123/179.4 |
| 6,218,799 | B1 * | 4/2001 | Hori | 318/446 |
| 6,453,864 | B1 * | 9/2002 | Downs et al. | 123/179.3 |
| 6,807,934 | B2 * | 10/2004 | Kataoka et al. | 123/179.4 |
| 6,834,632 | B2 * | 12/2004 | Kataoka et al. | 123/179.4 |
| 7,066,128 | B2 * | 6/2006 | Satake et al. | 123/179.4 |
| 7,079,939 | B2 | 7/2006 | Kataoka et al. | |
| 7,133,764 | B2 * | 11/2006 | Kassner | 701/112 |
| 7,234,442 | B2 * | 6/2007 | Hanson et al. | 123/179.4 |
| 7,261,076 | B2 * | 8/2007 | Hoevermann | 123/179.4 |
| 7,446,497 | B2 | 11/2008 | Iwashita et al. | |
| 7,653,478 | B2 | 1/2010 | Park | |
| 7,669,569 | B2 * | 3/2010 | Tamai et al. | 123/179.4 |
| 8,000,885 | B2 * | 8/2011 | Nakai | 701/112 |
| 8,292,778 | B2 * | 10/2012 | Watanabe et al. | 180/65.285 |
| 8,316,810 | B2 * | 11/2012 | Holz et al. | 123/179.4 |
| 8,453,620 | B2 * | 6/2013 | Abboud et al. | 123/333 |
| 2003/0163244 | A1 * | 8/2003 | Ando et al. | 701/112 |
| 2004/0149247 | A1 * | 8/2004 | Kataoka et al. | 123/179.4 |
| 2005/0229889 | A1 * | 10/2005 | Hoevermann | 123/179.4 |
| 2005/0278109 | A1 * | 12/2005 | Ando | 701/112 |

(Continued)

*Primary Examiner* — Hieu T Vo
*Assistant Examiner* — Arnold Castro
(74) *Attorney, Agent, or Firm* — Quinn Law Group, PLLC

(57) ABSTRACT

A method is provided for controlling engine stop position in a vehicle having an engine with auto stop/auto start functionality. The method includes automatically ramping down engine speed upon initiation of an auto stop event, executing closed-loop speed control of the engine when the engine speed begins to ramp down, and for as long as the engine speed remains above a threshold engine speed while ramping down the engine speed; executing closed-loop position control of the engine while ramping down the engine speed once the engine speed is less than the threshold engine speed and greater than zero; and stopping the crankshaft to within a calibrated range of a targeted engine stop position. A controller is also provided that includes a hardware module and an algorithm adapted for executing the foregoing method, and a vehicle is provided having an engine with auto stop/start functionality and the controller noted above.

15 Claims, 2 Drawing Sheets

(56) References Cited

U.S. PATENT DOCUMENTS

| | | | | |
|---|---|---|---|---|
| 2006/0016413 | A1* | 1/2006 | Satake et al. | 123/179.4 |
| 2006/0048734 | A1* | 3/2006 | Kataoka et al. | 123/179.4 |
| 2007/0062476 | A1* | 3/2007 | Ota et al. | 123/179.4 |
| 2007/0151536 | A1* | 7/2007 | Yamauchi et al. | 123/179.4 |
| 2007/0295297 | A1* | 12/2007 | Tamai et al. | 123/179.4 |
| 2008/0083390 | A1* | 4/2008 | Nishikiori | 123/179.4 |
| 2008/0127935 | A1* | 6/2008 | Park | 123/332 |
| 2010/0036590 | A1* | 2/2010 | Nakai | 701/112 |
| 2010/0036591 | A1* | 2/2010 | Nakai | 701/112 |
| 2010/0042311 | A1* | 2/2010 | Nakai | 701/112 |
| 2010/0204908 | A1* | 8/2010 | Nakai | 701/112 |
| 2011/0208411 | A1* | 8/2011 | Tsuji et al. | 701/112 |

* cited by examiner

MULTI-PHASE ENGINE STOP POSITION CONTROL

TECHNICAL FIELD

The present invention relates to the control of an engine in a vehicle having engine auto stop/auto start functionality.

BACKGROUND OF THE INVENTION

Hybrid electric vehicles (HEV) use different onboard energy sources, either individually or together, in order to optimize fuel economy. An HEV having a full hybrid powertrain can use either or both of an internal combustion engine and a high-voltage (HV) energy storage system (ESS) for propulsion. One or more HV motor/generator units (MGU) may alternately draw power from and deliver power to the ESS. By way of contrast, a mild HEV ordinarily cannot be propelled by electrical means, but nevertheless retains certain fuel saving powertrain design features of the full HEV. For example, a mild HEV is able to selectively shut off and restart its engine when the vehicle is stationary, thus reducing idle fuel consumption relative to conventional vehicle designs.

SUMMARY OF THE INVENTION

Accordingly, a method is provided herein for use in a vehicle having engine auto start/auto stop functionality. Execution of the method set forth herein precisely positions the engine to within a calibrated range of a targeted stop position, i.e., a desired cranking angle of the engine's crankshaft. This in turn may help to improve the smoothness of the cranking and starting phase of a given engine auto start/stop cycle, doing so in part by reducing the required spin-up compression torque, and by shortening synchronization time. The method may be embodied as an algorithm. The algorithm may be programmed into and automatically executed by an onboard controller in response to certain vehicle operating values and conditions.

In particular, a method for controlling engine stop position is provided for use in a vehicle having an engine with auto stop/auto start functionality. The method includes automatically ramping down engine speed upon initiation of an auto stop event, and then executing closed-loop speed control of the engine when the engine speed begins to ramp down. Closed loop speed control is maintained during the ramp down phase for as long as engine speed remains above a calibrated threshold engine speed. The method includes executing closed-loop position control of the engine crankshaft when a predetermined condition is detected, e.g., once engine speed is less than the threshold engine speed, but while still non-zero, and/or when an engine profile position passes a calibrated trigger position. The engine is stopped at a cranking angle or stop position falling within a calibrated range of a targeted engine stop position or angle.

A controller is also provided for a vehicle having auto stop/auto start functionality. The controller includes a hardware module and an algorithm, with the algorithm being executable via the hardware module. When the algorithm is executed, the cranking position of the engine is controlled during an auto stop event, with the crankshaft stopping to within a calibrated range of a targeted stop position as noted above.

A vehicle is also provided having a controller and algorithm as noted above. The vehicle includes an engine with auto start/auto stop functionality, and a controller adapted for controlling a cranking position of the engine during an auto stop event. The algorithm automatically ramps down engine speed upon initiation of the auto stop event, and executes closed-loop speed control of the engine when engine speed begins to ramp down, doing so for as long as engine speed remains above a threshold. The algorithm is also adapted for executing closed-loop position control of the engine while ramping down the engine speed when the predetermined condition is detected, and for stopping the engine within a calibrated range of a targeted engine stop position. Other factors other than engine speed may be used with engine speed or in lieu of it as the threshold value, e.g., trajectory values or changing cranking angle, without departing from the intended scope of the invention.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
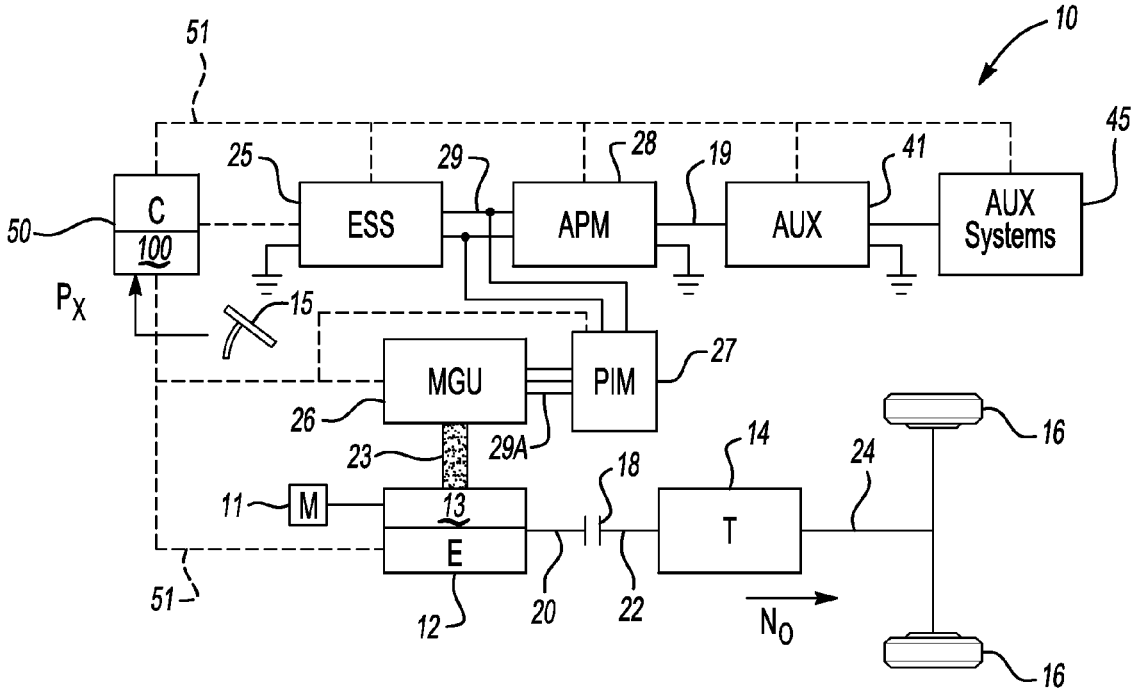
FIG. 1 is a schematic illustration of a vehicle having auto stop/auto start functionality and a controller with an engine stop position control algorithm.

Referring to the drawings, wherein like reference numbers correspond to like or similar components throughout the several figures, FIG. 1 shows a vehicle 10 having an engine 12 with a crankshaft 13. The engine 12 has the auto stop/auto start functionality noted above, thus minimizing idle fuel consumption. That is, the vehicle 10 is adapted for selectively shutting off its engine (E) 12, i.e., executing an auto stop event, when the vehicle is stationary, and for restarting the engine, i.e., executing an auto start event, when propulsion is again requested by the driver. The vehicle 10 includes a controller 50 having a hardware module 17 and an algorithm 100, executable by the hardware module, and adapted for precisely controlling a stop position of crankshaft 13 in order to minimize variation of the stop position from a desired target value. One possible embodiment of algorithm 100 is explained below with reference to FIG. 2.

To initiate propulsion, vehicle 10 includes an accelerator pedal 15 having a detectable pedal position (arrow $P_X$), with the pedal position being transmitted to and/or read by the controller 50 to determine or detect a requested restart of the engine 12. The engine 12 has an engine speed ($N_E$), and includes a crankshaft 13 and an output member 20. The vehicle 10 also includes a transmission (T) 14 having an input member 22 and an output member 24. Output member 20 of engine 12 may be selectively connected to input member 22 via a clutch 18. Transmission 14 may be configured as an electrically variable transmission (EVT) or any other suitable transmission capable of transmitting propulsive torque to wheels 16 via the output member 24. The output member 24 of transmission 14 rotates at an output speed ($N_O$) in response to an output speed request, which is ultimately determined by the controller 50.

The vehicle 10 may include a high-voltage (HV) electric motor/generator unit (MGU) 26, or multiple such MGUs depending on the design. MGU 26 may be configured as a multi-phase electric machine having a potential of approximately 60 volts (V) to approximately 300V or more. MGU 26 is electrically connected to an HV battery or an energy storage system (ESS) 25 via an HV DC power bus 29, a Power Inverter Module (PIM) 27, and an HV alternating current (AC) power bus 29A. The ESS 25 may be selectively recharged using the MGU 26 whenever the MGU is operating in its capacity as a generator, for example by capturing energy during a regenerative braking event.

During normal operation of vehicle 10, the MGU 26 may be used to selectively rotate a belt 23 to crank and start the engine 12 via crankshaft 13, or alternately an auxiliary starter motor 11 may be used for this purpose. The vehicle 10 may also include an auxiliary power module (APM) 28, e.g., a buck-type and/or boost-type DC-DC power converter, which is electrically connected to the ESS 25 via the DC power bus 29. The APM 28 may be electrically connected to an auxiliary battery 41, e.g., a 12-volt DC battery, via a low-voltage (LV) power bus 19, and adapted for energizing auxiliary systems 45 aboard the vehicle 10.

Still referring to FIG. 1, the controller 50 may be configured as a single or a distributed control device that is electrically connected to or otherwise in hard-wired or wireless communication with each of the engine 12, MGU 26, ESS 25, APM 28, PIM 27, and auxiliary battery 41 via control channels 51, as illustrated by dashed lines. Control channels 51 may include any required transfer conductors, e.g., a hard-wired or wireless control link(s) or path(s) suitable for transmitting and receiving the necessary electrical control signals to ensure proper power flow control and coordination aboard the vehicle 10. The controller 50 may include such control modules and capabilities as might be necessary to execute all required functionality.

Hardware module 17 of the controller 50 may be configured as a digital computer generally comprising a microprocessor or central processing unit, read only memory (ROM), random access memory (RAM), electrically-erasable programmable read only memory (EEPROM), a high-speed clock, analog-to-digital (A/D) and digital-to-analog (D/A) circuitry, and input/output circuitry and devices (I/O), as well as appropriate signal conditioning and buffer circuitry. Any algorithms resident in the hardware module 17 or accessible thereby, including the auto stop/auto start cycling frequency optimizing algorithm 100 in accordance with the invention as described below with reference to FIG. 2, can be stored in ROM and automatically executed to provide the respective functionality.

As noted above, and used herein, the term "auto stop" refers to the capability of vehicle 10 to selectively shut down its engine 12 whenever the vehicle is idle or at a standstill, such as while waiting at an intersection, in heavy traffic, parked, or when otherwise determined by the control logic resident within the controller 50. In this manner, the vehicle 10 is able to minimize idle fuel consumption. After an auto stop event, the MGU 26 or the starter motor 11 may be used to crank and start the engine 12 via crankshaft 13, with this process referred to herein as an "auto start" event.

The controller 50 is programmed with or otherwise has access to algorithm 100. Controller 50 executes algorithm 100 to provide closed-loop control of engine speed ($N_E$) after initiation of an auto stop event, and when engine speed ($N_E$) just begins ramping down. At substantially lower engine speeds, the controller 50 automatically switches to closed-loop control of engine position, i.e., an angular position of the crankshaft 13, with engine position trajectory being a calibratable profile. One possible embodiment of algorithm 100 will now be described with reference to FIG. 2.

Figure 2:
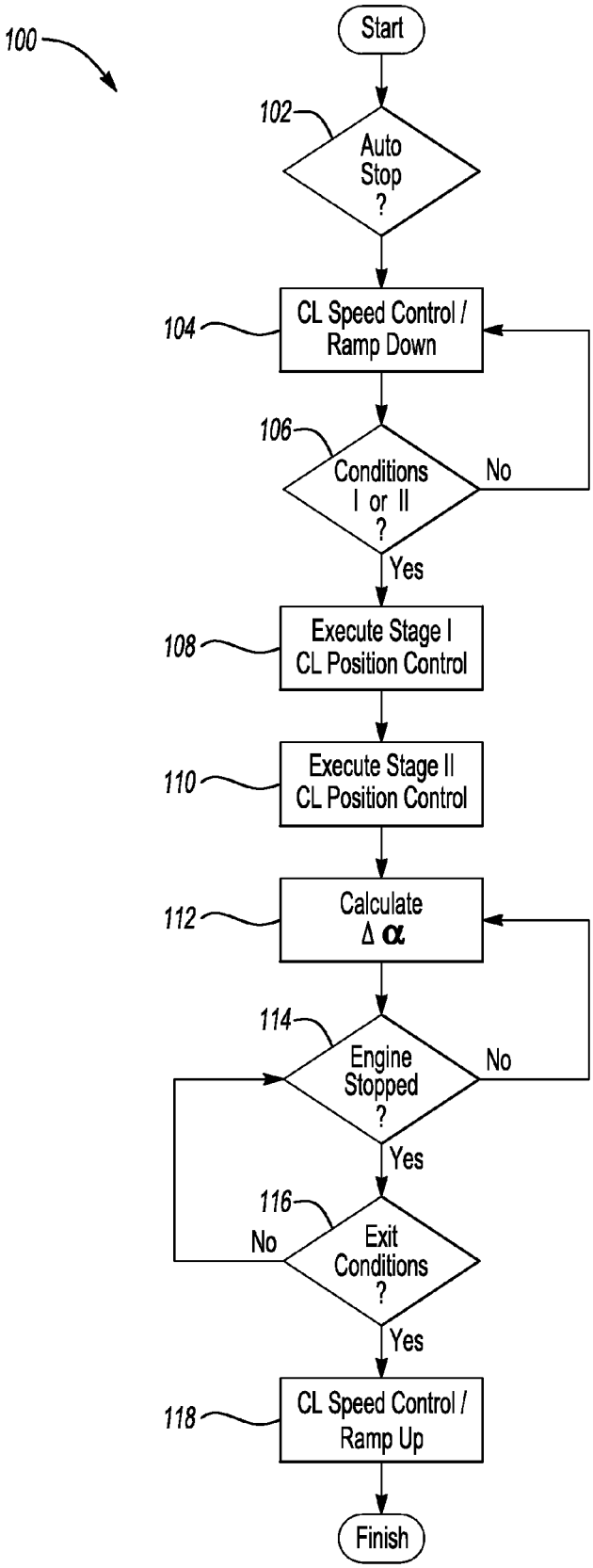
FIG. 2 is a graphical flow chart describing the engine stop position control of the vehicle shown in FIG. 1.

Referring to FIG. 2, the algorithm 100 commences at step 102, wherein controller 50 detects or otherwise determines whether an auto stop event has initiated. If the auto stop event has initiated, algorithm 100 proceeds to step 104, with the algorithm otherwise exiting.

At step 104, with the auto stop event having been detected at step 102, engine speed ($N_E$) begins to ramp down. Closed-loop control of engine speed ($N_E$) commences, and the algorithm 100 proceeds to step 106.

At step 106, the controller 50 references engine speed ($N_E$) and a value of a calibrated engine profile trigger position ($PT_{CAL}$) that may be stored in controller 50. If engine speed ($N_E$) is below a threshold speed (i.e., Condition I), or if the engine profile position/trajectory passes the calibrated profile trigger position ($PT_{CAL}$) (Condition II), the algorithm 100 proceeds to step 108, and otherwise repeats steps 104 and 106.

At step 108, the controller 50 switches from closed-loop control of engine speed ($N_E$) to a first stage of closed-loop control of engine position, doing so based on position trajectory, and using proportional-integral (PI) controls, i.e., when the controller 50 is configured as a PI controller. An angular change feedback variable ($\Delta\alpha$) is calculated by controller 50 using the equation: $\Delta\alpha$=current position angle ($\alpha_{CURRENT}$)−position angle profile ($\alpha_{PROFILE}$), i.e., the difference between the presently measured angular value of the crankshaft 13 of FIG. 1 and a corresponding value in a calibrated trajectory. For the PI controls, the P-term is equal to $\Delta\alpha*P_{GAIN}$. Likewise, the I-term is equal to the I-term in the immediately prior loop+$\Delta\alpha*I_{GAIN}$. The P and I gain values may be calibrated and stored in controller 50. At the moment of transition from closed-loop engine speed to closed-loop position control, the I-term may be set to a calibrated initial value, e.g., a function of transmission mode or state, auto stop type, vehicle speed, or any other suitable variables. Algorithm 100 then proceeds to step 110.

At step 110, the algorithm 100 enters a finish state, i.e., a second stage of closed-loop engine position control. At step 110, the controller 50 determines whether (I) the current engine position ($\alpha_{CURRENT}$) has passed the calibrated trigger position ($PT_{CAL}$), or if engine speed ($N_E$) is less than a calibrated engine speed value. If either cases (I) or (II) is present, the algorithm 100 proceeds to step 112, otherwise the algorithm repeats step 110.

At step 112, the feedback variable ($\Delta\alpha$) noted above is calculated by controller 50 via the equation: $\Delta\alpha$=Targeted engine stop position ($PS_{CAL}$)−$\alpha_{current}$−X, where X is a calibrated desired position. The P-term and the I-term may be calculated as set forth above in step 106. The algorithm 100 proceeds to step 114.

At step 114, the controller 50 determines whether the engine 12 has stopped. If so, the algorithm 100 proceeds to step 116, otherwise it repeats step 112.

At step 116, the controller 50 may determine whether a suitable exit condition is present. Inclusion of step 116 may help to prevent engine roll back, as understood in the art. One possible exit condition may be as follows: (I) if elapsed time in stage two>$t_{MIN}$, i.e., a calibrated minimum duration spent in stage two and $\Delta\alpha$<a calibrated threshold, or (II) if elapsed time in stage two equals or exceeds a calibrated maximum time, i.e., $t_{MAX}$. The final I-term of the PI controls may be set to a calibrated value, which may be a function of transmission state, engine speed, engine direction, etc. If these exit conditions are present, the algorithm 100 proceeds to step 118, otherwise repeating step 114.

At step 118, the controller 50 initiates closed-loop speed control while engine speed ($N_E$) ramps up. The algorithm 100 is then finished, effectively resuming with step 102. By executing algorithm 100, the stop position of engine 12 may be precisely controlled. The crankshaft 13 is stopped at a predictable and repeatable angular position, thus minimizing spin-up disturbances and allowing for faster combustion upon engine restart. Torque reduction and/or motor reaction errors may be enabled for the MGU 26, or any additional MGUs used in multi-motor vehicle designs. Less battery power may be used, as well as a reduced amount of required spark retarding.

While the best modes for carrying out the invention have been described in detail, those familiar with the art to which this invention relates will recognize various alternative designs and embodiments for practicing the invention within the scope of the appended claims.

The invention claimed is:

1. A vehicle comprising:

an engine with a crankshaft and auto start/auto stop functionality;

a transmission having a transmission state; and a proportional-integral (PI) controller adapted for controlling a cranking position of the engine during an auto stop event, wherein the PI controller is in communication with the engine, and is configured for:

automatically ramping down engine speed upon initiation of an auto stop event;

executing closed-loop speed control of the engine when the engine speed begins to ramp down, and for as long as the engine speed remains above a threshold engine speed while ramping down the engine speed;

setting an I-term of the PI controller as a function of at least the transmission state and a speed of the vehicle;

after setting the I-term, executing closed-loop position control of the engine while ramping down the engine speed when a predetermined condition is detected; and stopping the crankshaft to within a calibrated range of a targeted engine stop position.

2. The vehicle of claim 1, wherein the algorithm is further adapted for switching back to closed-loop speed control of the engine once the engine speed equals zero.

3. The vehicle of claim 2, wherein the predetermined condition includes one of: the engine speed being less than the threshold engine speed and greater than zero, and an engine profile position passing a calibrated trigger position.

4. The vehicle of claim 2, wherein the algorithm is further adapted for:

calculating a changing angular value of the crankshaft; and using the changing angular value of the engine as a closed-loop feedback variable during the closed-loop position control.

5. The vehicle of claim 2, wherein the algorithm is further adapted for:

determining if a set of exit conditions is present when the engine is stopped; and transitioning from closed-loop position control to closed-loop speed control only if the set of exit conditions is present.

6. A proportional-integral (PI) controller for use aboard a vehicle having a transmission and an engine with a crankshaft and auto stop/auto start functionality, the controller comprising a hardware module and an algorithm adapted for controlling a cranking position of the engine during an auto stop event, wherein the algorithm is adapted for:

automatically ramping down engine speed upon initiation of an auto stop event;

executing closed-loop speed control of the engine when the engine speed begins to ramp down, and for as long as the engine speed remains above a threshold engine speed while ramping down the engine speed;

setting an I-term of the PI controller as a function of at least a state of the transmission and a speed of the vehicle;

after setting the I-term, executing closed-loop position control of the engine while ramping down the engine speed when a predetermined condition is detected; and stopping the crankshaft to within a calibrated range of a targeted engine stop position.

7. The controller of claim 6, wherein the algorithm is further adapted for switching back to closed-loop speed control of the engine once the engine speed equals zero.

8. The controller of claim 6, wherein the predetermined condition includes one of: the engine speed being less than the threshold engine speed and greater than zero, and an engine profile position passing a calibrated trigger position.

9. The controller of claim 6, wherein the algorithm is further adapted for:

calculating a changing angular value of the crankshaft; and using the changing angular value of the engine as a closed-loop feedback variable during the closed-loop position control.

10. The controller of claim 6, wherein the algorithm is further adapted for:

determining if a set of exit conditions is present when the engine is stopped; and transitioning from closed-loop position control to closed-loop speed control only if the set of exit conditions is present.

11. A method for controlling an engine stop position in a vehicle having a proportional-integral (PI) controller, a transmission having a transmission state, and an engine with auto stop/auto start functionality and a crankshaft, the method comprising:

automatically ramping down engine speed upon initiation of an auto stop event;

executing closed-loop speed control of the engine when the engine speed ramps down, and for as long as the engine speed remains above a threshold engine speed;

setting an I-term of the PI controller as a function of at least the transmission state and a speed of the vehicle;

after setting the I-term, executing closed-loop position control of the engine while ramping down the engine speed when a predetermined condition is detected; and stopping the crankshaft of the engine to within a calibrated range of a targeted engine stop position.

12. The method of claim 11, further comprising: switching back to closed-loop speed control of the engine once the engine speed equals zero.

13. The method of claim 11, wherein the predetermined condition includes one of: the engine speed being less than the threshold engine speed and greater than zero, and an engine profile position passing a calibrated trigger position.

14. The method of claim 11, further comprising:

calculating a changing angular value of the crankshaft; and using the changing angular value of the engine as a closed-loop feedback variable during the closed-loop position control.

15. The method of claim 11, further comprising:

determining if a set of exit conditions is present when the engine is stopped; and transitioning from closed-loop position control to closed-loop speed control only if the set of exit conditions is present.

* * * * *